US008911040B2

(12) United States Patent
You et al.

(10) Patent No.: US 8,911,040 B2
(45) Date of Patent: Dec. 16, 2014

(54) REFRIGERATOR

(71) Applicants: Myungdong You, Seoul (KR); Minsup Kim, Seoul (KR); Seonkyu Kim, Seoul (KR); Junyi Heo, Seoul (KR); Insun Yeo, Seoul (KR)

(72) Inventors: Myungdong You, Seoul (KR); Minsup Kim, Seoul (KR); Seonkyu Kim, Seoul (KR); Junyi Heo, Seoul (KR); Insun Yeo, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 13/673,356

(22) Filed: Nov. 9, 2012

(65) Prior Publication Data

US 2013/0134854 A1 May 30, 2013

(30) Foreign Application Priority Data

Nov. 30, 2011 (KR) ..... 10-2011-0127152

(51) Int. Cl.
*A47B 96/04* (2006.01)
*F25D 23/02* (2006.01)

(52) U.S. Cl.
CPC ..... *F25D 23/028* (2013.01)
USPC ..... 312/405; 312/291

(58) Field of Classification Search
CPC ..... A47B 96/04; A47B 96/14; A47B 77/00; A47B 77/10; A47B 46/00; A47B 95/00; A47B 49/00; A47B 88/00; A47B 96/16; F25D 25/02; F25D 25/025; F25D 25/027; F25D 23/02; F25D 23/08; A47F 3/0434
USPC ..... 312/405, 291–292
See application file for complete search history.

(56) References Cited

U.S. PATENT DOCUMENTS

| | | | | | |
|---|---|---|---|---|---|
| 1,630,160 | A * | 5/1927 | Bayless | 312/291 |
| 1,698,509 | A * | 1/1929 | Probert | 312/291 |
| 2,051,733 | A * | 8/1936 | Moore et al. | 62/265 |
| 2,062,856 | A * | 12/1936 | Armbruster | 312/273 |
| 2,130,617 | A * | 9/1938 | Dockham | 312/291 |
| 2,136,145 | A * | 11/1938 | Miner | 312/291 |
| 2,139,779 | A * | 12/1938 | Stratton | 312/296 |
| 2,146,707 | A * | 2/1939 | Bangert | 312/292 |
| 2,213,274 | A * | 9/1940 | Flamm | 62/265 |
| 2,235,454 | A * | 3/1941 | Koropchak | 160/37 |
| 2,248,813 | A * | 7/1941 | D'Arcey | 312/138.1 |
| 2,304,465 | A * | 12/1942 | Maniscalco | 62/329 |
| 2,406,750 | A * | 9/1946 | Dyett | 312/291 |
| 2,453,703 | A * | 11/1948 | De Carlo, Sr. | 62/265 |
| 2,470,956 | A * | 5/1949 | Savidge | 62/441 |
| 2,498,562 | A * | 2/1950 | Long | 62/246 |
| 2,594,036 | A * | 4/1952 | Knapp | 62/175 |
| 2,745,259 | A * | 5/1956 | Saunders | 62/266 |
| 3,757,958 | A * | 9/1973 | Kirkemo | 211/153 |
| 6,247,773 | B1 * | 6/2001 | Harigai et al. | 312/405 |
| 6,467,859 | B2 * | 10/2002 | Branz et al. | 312/292 |

(Continued)

FOREIGN PATENT DOCUMENTS

WO WO 2011093577 A1 * 8/2011

*Primary Examiner* — Darnell Jayne
*Assistant Examiner* — Ryan A Doyle
(74) *Attorney, Agent, or Firm* — McKenna, Long & Aldridge LLP

(57) ABSTRACT

A refrigerator includes a body having a cooling chamber, a door configured to open or close the cooling chamber, and a cover disposed at a front region of the cooling chamber so as to be movable up and down. Under such configuration, a temperature change occurring from a predetermined region inside the cooling chamber when the cooling chamber is open, can be prevented.

12 Claims, 13 Drawing Sheets

(56) References Cited

U.S. PATENT DOCUMENTS 7,654,107 B2 * 2/2010 Okuda et al. ..... 62/441
8,123,314 B2 * 2/2012 Becke ..... 312/405.1
2002/0190619 A1 * 12/2002 Brauer ..... 312/405
2003/0011291 A1 * 1/2003 Moreno-Olguin et al. 312/405.1
2007/0273261 A1 * 11/2007 Sellers ..... 312/405
2012/0293056 A1 * 11/2012 Kim ..... 312/405.1

* cited by examiner

REFRIGERATOR

CROSS-REFERENCE TO RELATED APPLICATION

Pursuant to 35 U.S.C. §119(a), this application claims the benefit of earlier filing date and right of priority to Korean Application No. 10-2011-0127152, filed on Nov. 30, 2011, the contents of which is incorporated by reference herein in its entirety.

BACKGROUND OF THE INVENTION

1. Field of the Invention

The present disclosure relates to a refrigerator, and particularly, to a refrigerator capable of being simply manipulated, and capable of preventing a temperature change at an inner space thereof.

2. Background of the Invention

As well known, a refrigerator is an apparatus for freshly storing food items in a frozen or cooled state.

The refrigerator may include a body having a cooling chamber, a door for opening or closing the cooling chamber, and a refrigerating cycle device for providing cool air to the cooling chamber.

The refrigerating cycle device may be configured as a vapor-compression type one including a compressor for compressing a refrigerant, a condenser for radiating a refrigerant, an expander for depressurization-expanding a refrigerant, and an evaporator for evaporating a refrigerant by absorbing peripheral latent heat.

FIG. 1 is a perspective view of a refrigerator in accordance with the conventional art.

As shown, the refrigerator includes a body 10 having a cooling chamber 20 therein, and a cooling chamber door 24 for opening or closing the cooling chamber 20.

The cooling chamber 20 may include a freezing chamber 21 and a refrigerating chamber 31.

For instance, the freezing chamber 21 and the refrigerating chamber 31 may be spaced from each other in upper and lower directions of the body 10.

For instance, the freezing chamber 21 may be provided at an upper side of the body 10, whereas the refrigerating chamber 31 may be provided below the freezing chamber 21.

A refrigerating cycle device (not shown) for providing cool air to the cooling chamber 20 may be provided at the body 10.

A cooling chamber door 24 for opening or closing the cooling chamber 20 may be provided on the front surface of the body 10.

For instance, the cooling chamber door 24 may be configured to be rotatable with respect to the body 10.

The cooling chamber door 24 may include a freezing chamber door 25 for opening or closing the freezing chamber 21, and a refrigerating chamber door 35 for opening or closing the refrigerating chamber 31.

Shelves 27 may be provided in the freezing chamber 21.

Shelf supporting portions 28 for supporting the shelves 27 may be provided in the freezing chamber 21.

A plurality of shelves 37 for partitioning the inside of the refrigerating chamber 31 in upper and lower directions may be provided in the refrigerating chamber 31.

Shelf supporting portions 38 for supporting the shelves 37 may be provided in the refrigerating chamber 31.

The shelf supporting portions 28 and 38 of the freezing chamber 21 and the refrigerating chamber 31 may be protruding from the inner wall surfaces of the freezing chamber 21 and the cooling chamber 31, and may extend back and forth.

However, the conventional refrigerator may have the following problems.

Firstly, when the cooling chamber door 24 is open, external air having a relatively higher temperature is introduced into the cooling chamber 20. This may cause food items stored in the cooling chamber 20 to be badly influenced (e.g., lowering of freshness) due to the high temperature of the external air. Especially, since the temperature difference between the freezing chamber 21 and the outside is relatively large, the external air may be introduced into the freezing chamber 21 more drastically.

Food items stored in the freezing chamber 21 have a relatively low temperature. Accordingly, if the food items come in contact with the external air, they may be badly influenced by the high temperature of the external air.

SUMMARY OF THE INVENTION

Therefore, an aspect of the detailed description is to provide a refrigerator capable of preventing the change of an inner temperature due to introduction of the external air when a door is open.

Another aspect of the detailed description is to provide a refrigerator capable of preventing cool air from leaking from one region of a freezing chamber when a door is open.

Still another aspect of the detailed description is to provide a refrigerator capable of preventing a temperature change occurring from a predetermined region inside a cooling chamber when the cooling chamber is open.

To achieve these and other advantages and in accordance with the purpose of this specification, as embodied and broadly described herein, there is provided a refrigerator, comprising: a body having a cooling chamber; a door configured to open or close the cooling chamber; and a cover disposed at a front region of the cooling chamber so as to be movable up and down.

At least a rail may be provided at the cooling chamber in upper and lower moving directions of the cover.

The rail may be concaved from a wall surface of the cooling chamber, and an insertion opening inserted into the rail may be provided at the cover.

The cover may be detachable.

The cooling chamber may include a freezing chamber and a refrigerating chamber, and the cover may be provided at the freezing chamber or the refrigerating chamber.

The refrigerator may further comprise a position fixing unit configured to fix the cover to an upward or downward-moved position.

The position fixing unit may include a protrusion provided at the cover, and an engaging portion engaged with the protrusion.

The engaging portion may be disposed in upper and lower moving directions of the cover.

The protrusion may be configured to elastically come in contact with the engaging portion.

The position fixing unit may include a protrusion unit provided at the cover, and an engaging portion engaged with the protrusion unit.

The protrusion unit may include a body of a plate shape, a protrusion supporting portion elastically-transformable with respect to the body, and a protrusion protruding from the protrusion supporting portion.

The body may be detachably coupled to the cover.

Slit may be formed at the circumference of the protrusion supporting portion such that one region of the protrusion supporting portion is connected to the body, and another region thereof is separated from the body.

The cover may include a frame that moves up and down along the rail, and a plate portion coupled to the frame. And, the protrusion may be provided at the frame.

Slit may be formed at the circumference of the protrusion such that one region of the protrusion is connected to the frame, and another region thereof is separated from the frame.

The insertion portion may be inserted into the rail with an elastic force.

The insertion portion may be provided with a free end having a width greater than an inner width of the rail.

The insertion portion may be provided in plurality so as to be spaced from each other in upper and lower directions.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of the exemplary embodiments, with reference to the accompanying drawings. For the sake of brief description with reference to the drawings, the same or equivalent components will be provided with the same reference numbers, and description thereof will not be repeated.

Hereinafter, a refrigerator according to the present invention will be explained in more details with reference to the attached drawings.

Figure 1:
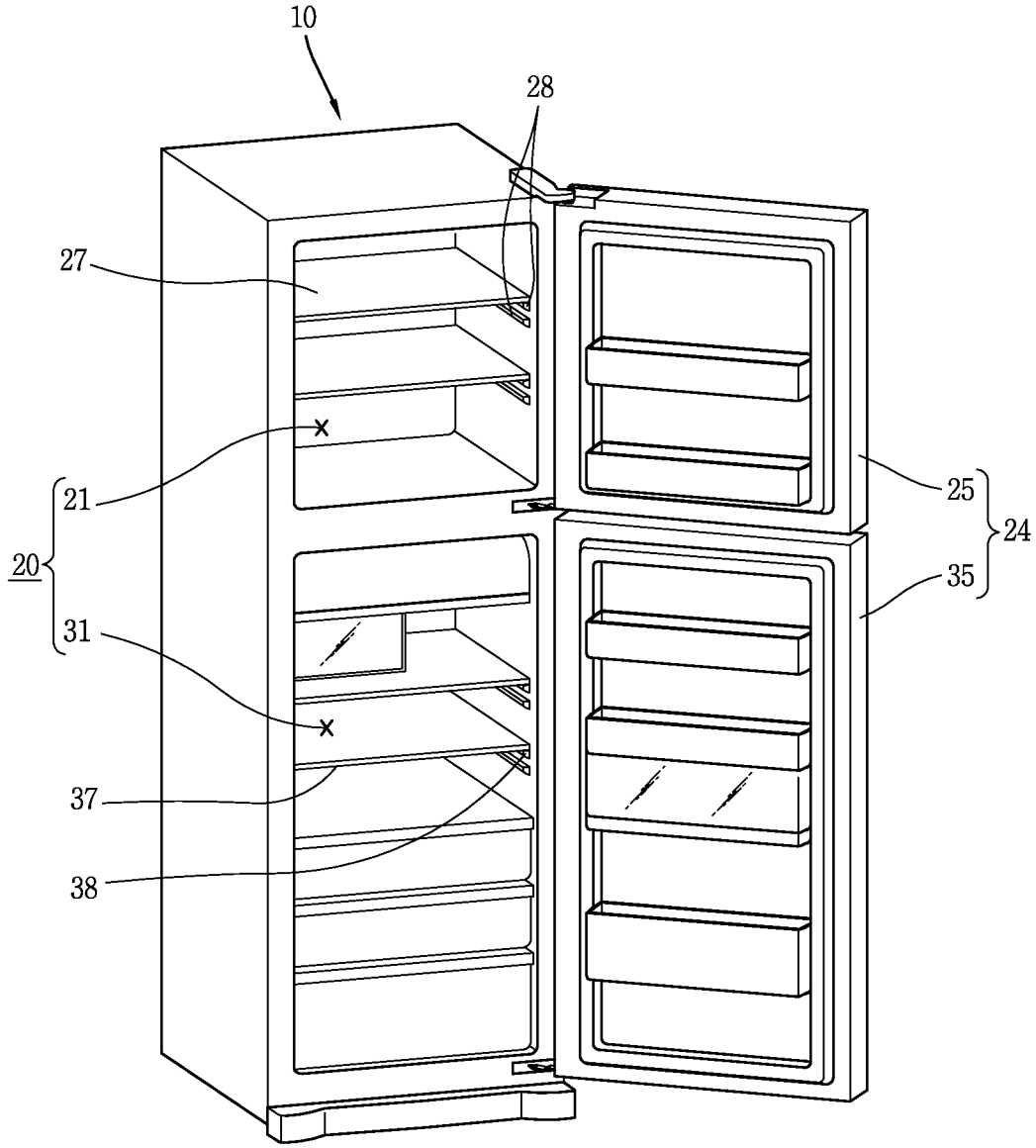
FIG. 1 is a perspective view of a refrigerator in accordance with the conventional art.
Figure 2:
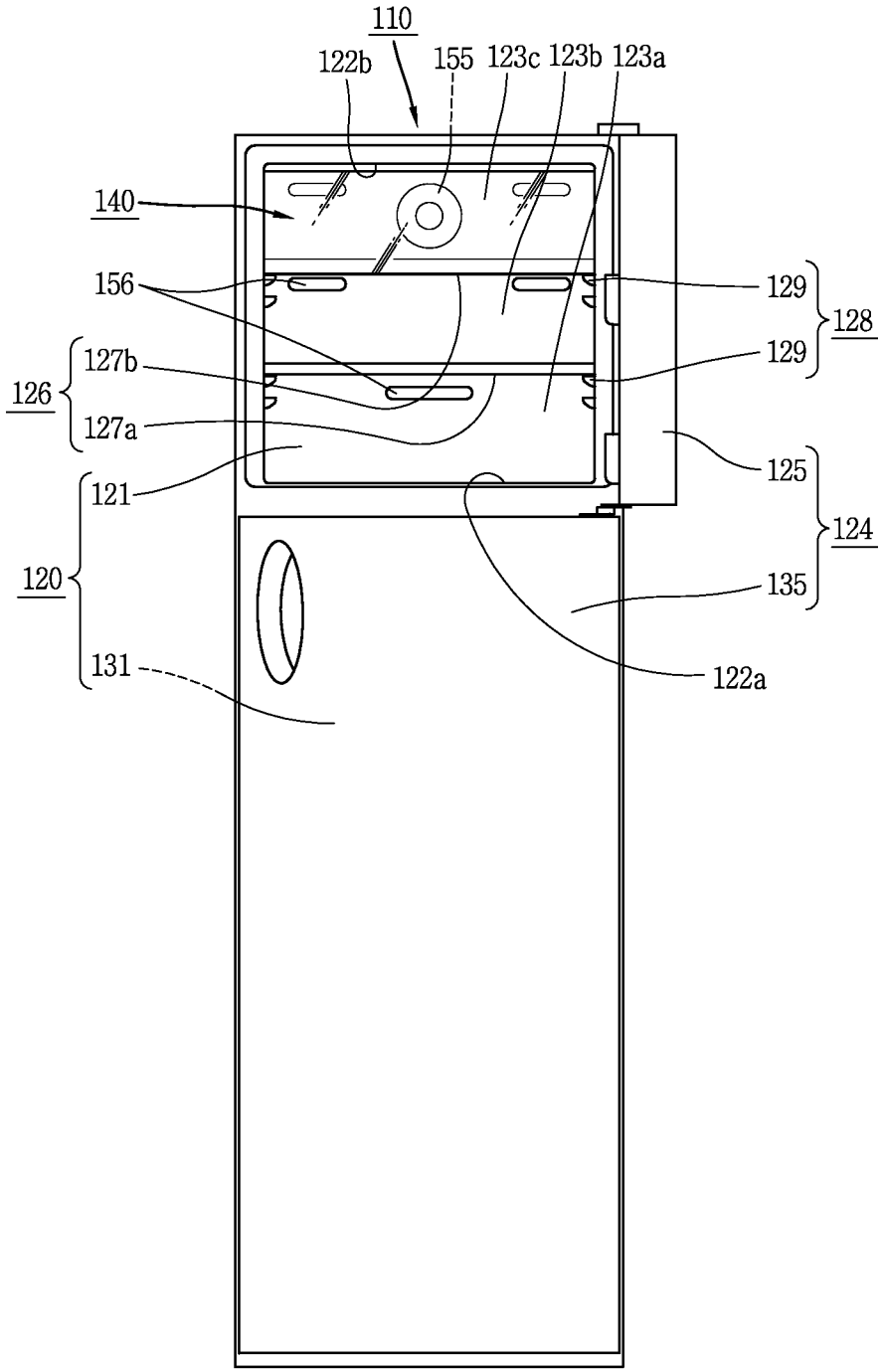
FIG. 2 is a perspective view of a refrigerator according to an embodiment of the present invention.
Figure 3:
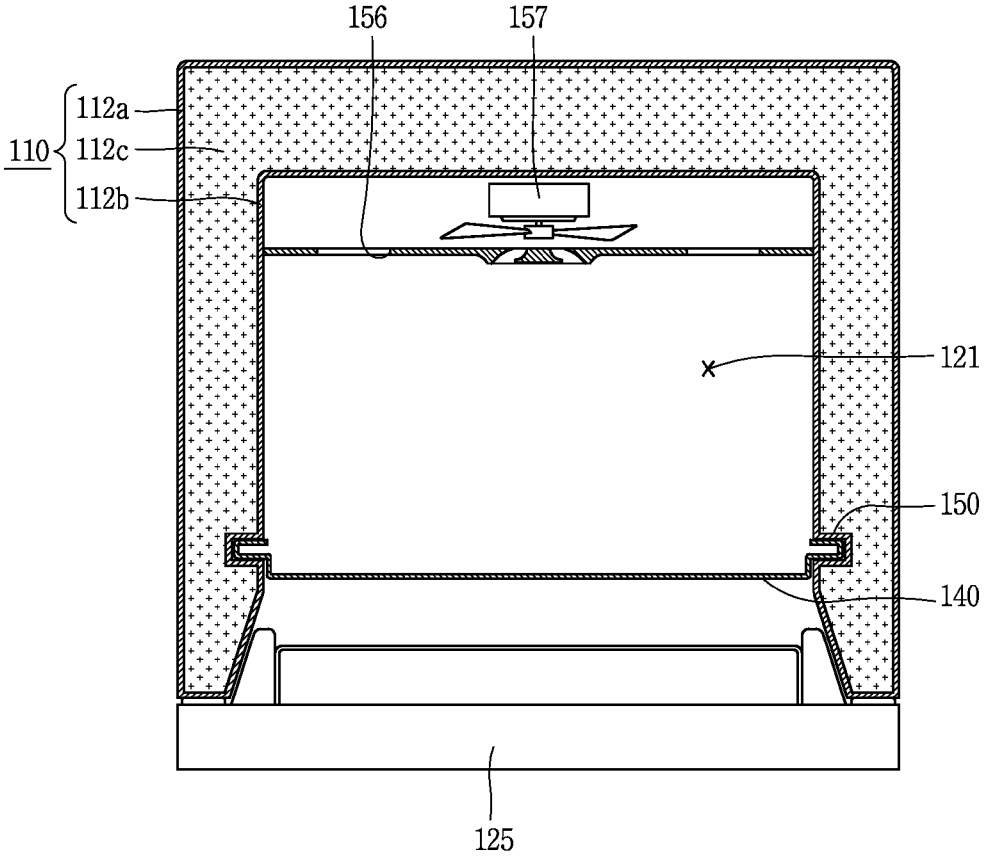
FIG. 3 is a planar sectional view of a freezing chamber of FIG. 2.

As shown in FIGS. 2 and 3, a refrigerator according to an embodiment of is the present invention comprises a body 110 having a cooling chamber 120, a door 124 for opening or closing the cooling chamber 120, and a cover 140 disposed at a front region of the cooling chamber 120 so as to be movable up and down. The cooling chamber 120 indicates a space for storing food items in a cool state, for example, a freezing chamber 121 and a refrigerating chamber 131. The body 110 may be provided at least one of the freezing chamber 121 and the refrigerating chamber 131.

The freezing chamber 121 may be provided at an upper region of the body 110.

The refrigerating chamber 131 may be provided below the freezing chamber 121 of the body 110.

The door 124 may include a freezing chamber door 125 for opening or closing the freezing chamber 121, and a refrigerating chamber door 135 for opening or closing the refrigerating chamber 131.

The body 110 may include a case 112*a* for forming the appearance, and an inner case 112*b* disposed in the case 112*a* in a state where a space for filling a foaming agent 112*c* is interposed therebetween. The foaming agent 112*c* may be filled in a space between the case 112*a* and the inner case 112*b*.

A refrigerating cycle device (not shown) for providing cool air to the cooling chamber 120 (freezing chamber 121 and the cooling chamber 131) may be provided at the body 110.

The refrigerating cycle device may be configured as a vapor-compression type one including a compressor for compressing a refrigerant, a condenser for radiating a refrigerant, an expander for depressurization-expanding a refrigerant, and an evaporator for evaporating a refrigerant by absorbing peripheral latent heat.

A shelf 126 may be provided in the freezing chamber 121, through which the inside of the freezing chamber 121 may be divided into a plurality of spaces.

The shelf 126 may be provided in plurality. For instance, two shelves 126 may be spaced from each other in the freezing chamber 121 in upper and lower directions.

Shelf supporting portions 128 for supporting the shelves 126 may be provided on two side walls of the freezing chamber 121.

The shelf supporting portions 128 may be provided with support protruding portions 129 protruding from the side walls of the freezing chamber 121, and extending back and forth.

The support protruding portions 129 may be configured to have heights different from each other, so that the height from a bottom surface 122*a* of the freezing chamber 121 can be controlled. The support protruding portions 129 may be configured to face each other at the same height on two side walls, so that the shelves 126 can be supported from the two lower sides thereof.

An illumination portion 155 for illuminating the inside of the freezing chamber 121 may be provided at a rear region of the freezing chamber 121.

A plurality of cool air discharge openings 156 may be provided at a rear region of the freezing chamber 121. A blowing fan 157 for blowing cool air may be provided behind the cool air discharge openings 156.

The cool air discharge openings 156 may be spaced from each other in upper and lower directions.

For instance, the cool air discharge openings 156 may be formed to correspond to spaces partitioned from each other by the shelves 126.

More concretely, the shelves 126 may include a first shelf 127*a* and a second shelf 127*b* spaced from each other in upper and lower directions of the freezing chamber 121. Under this configuration, the inside of the freezing chamber 121 may be divided into three spaces. For instance, a lower compartment 123*a* may be formed between a bottom surface 122*a* of the freezing chamber 121 and the first shelf 127*a*. A middle compartment 123*b* may be formed between the first shelf 127*a* and the second shelf 127*b*. And, an upper compartment 123*c* may be formed between the second shelf 127*b* and a ceiling 122*b* of the freezing chamber 121. The lower compartment 123*a*, the middle compartment 123*b* and the upper compartment 123*c* may be configured to have the same height. However, in case of controlling the positions of the first shelf 127*a* and the second shelf 127*b*, the lower compartment 123*a*, the middle compartment 123*b* and the upper compartment 123*c* may have heights different from one another.

The cool air discharge openings 156 may be formed at heights where cool air can be supplied to the lower compartment 123*a*, the middle compartment 123*b* and the upper compartment 123*c*, respectively.

A cover 140 may be provided on a front surface of the freezing chamber 121.

The cover 140 may be configured to be movable up and down in upper and lower directions of the freezing chamber 121.

Rails 150 for guiding upward and downward movements of the cover 140 may be provided on two side walls of the freezing chamber 121.

Figure 4:
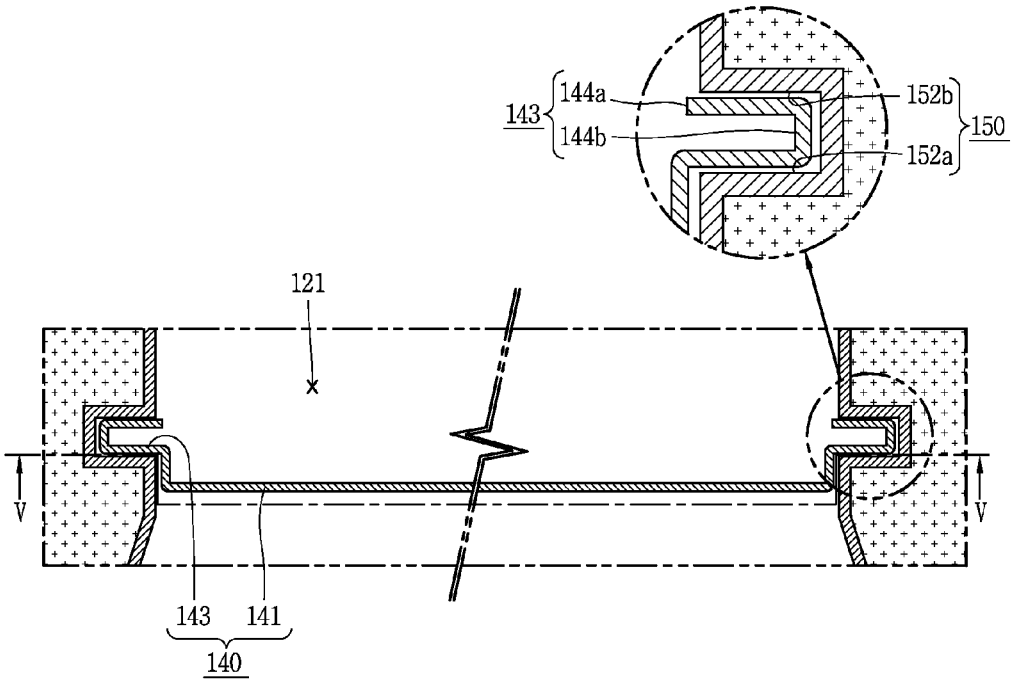
FIG. 4 is an enlarged view of a main part of FIG. 3.
Figure 5:
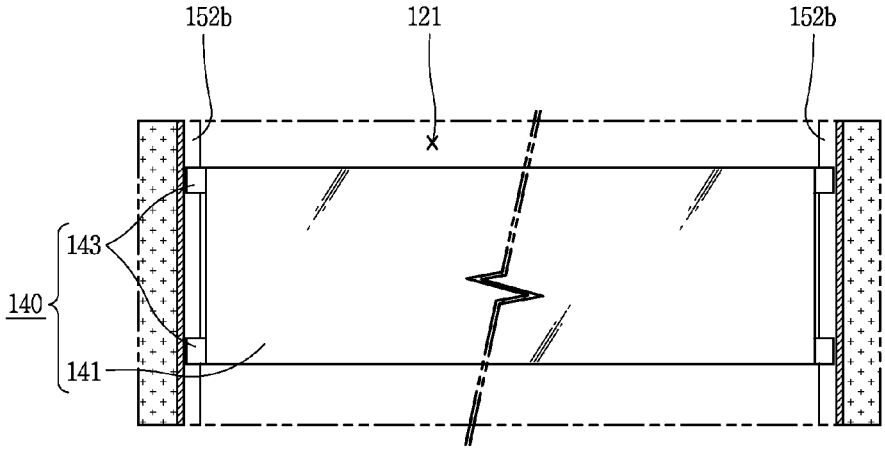
FIG. 5 is a sectional view taken along line 'V-V' in FIG. 4.

As shown in FIGS. 3 to 5, the rails 150 may be inward concaved from the side wall surfaces of the freezing chamber 121, and may extend in upper and lower directions.

The rails 150 may be formed at the inner case 112*b*. That is, the rails 150 is may be integrally formed with the inner case 112*b*.

The cover 140 may be formed in a rectangular plate shape.

For instance, the cover 140 may be formed to have the length corresponding to the width of the freezing chamber 121 in right and left directions.

The cover 140 may be configured to have the same height as that of a front surface of one of the lower compartment 123*a*, the middle compartment 123*b* and the upper compartment 123*c*.

The cover 140 may be detachable.

For instance, the cover 140 may include a cover body 141 having a plate shape, and insertion portions 143 provided at the cover body 141 and inserted into the rails 150.

The insertion portions 143 may protrude from two sides of the cover body 141 in a lengthwise direction.

As shown in FIG. 5, the insertion portions 143 may be spaced from each other up and down on two sides.

The insertion portions 143 may be configured to be elastically-transformable.

For instance, the insertion portions 143 may be configured to be elastically-transformable in a widthwise direction of the rail 150 (i.e., back and forth directions of the freezing chamber 121).

The insertion portions 143 may be configured to elastically contact an inner wall surface of the rails 150 (front wall surface 152*a* and/or rear wall surface 152*b*).

The insertion portions 143 may be formed to have an approximate 'U'-shaped section.

One side of the insertion portion 143 may be connected to the cover body 141. A free end 144*a* of the insertion portion 143 may be configured to be outward widened. More specifically, the free end 144*a* of the insertion portion 143 may be formed to have an outer width extended than an inner width of the rail 150. Under such configuration, the insertion portions 143 are inserted into the rails 150 by being elastically-transformed (compressed) so that an outer width of the free end 144*a* can be contracted. As a result, the insertion portions 143 can elastically come in contact with an inner wall of the rails 150. The insertion portions 143 having been inserted into the rails 150 move to proper positions, along the rails 150, with a predetermined elastic force. Under such configuration, the cover 140 can be prevented from being suddenly lowered. Another end 144*b* of the insertion portion 143 (which faces the free end 144*a*) may be configured so that an inner width thereof can be smaller than an inner width of the rail 150. Accordingly, the insertion portions 143 can be easily inserted into the rails 150.

Under such configuration, if one of the two insertion portions 143 of the cover 140 is inward pressurized on an opening of the corresponding rail 150, the insertion portion 143 can be inserted into the corresponding rail 150. Next, if another of the two insertion portions 143 of the cover 140 is inward pressurized on an opening of the corresponding rail 150, the insertion portion 143 can be inserted into the corresponding rail 150. As the free end 144*a* of the insertion portion 143 elastically contacts an inner wall surface of the rail 150, the cover 140 is prevented from downward moving to thereby be temporarily fixed to the inserted position.

Figure 6:
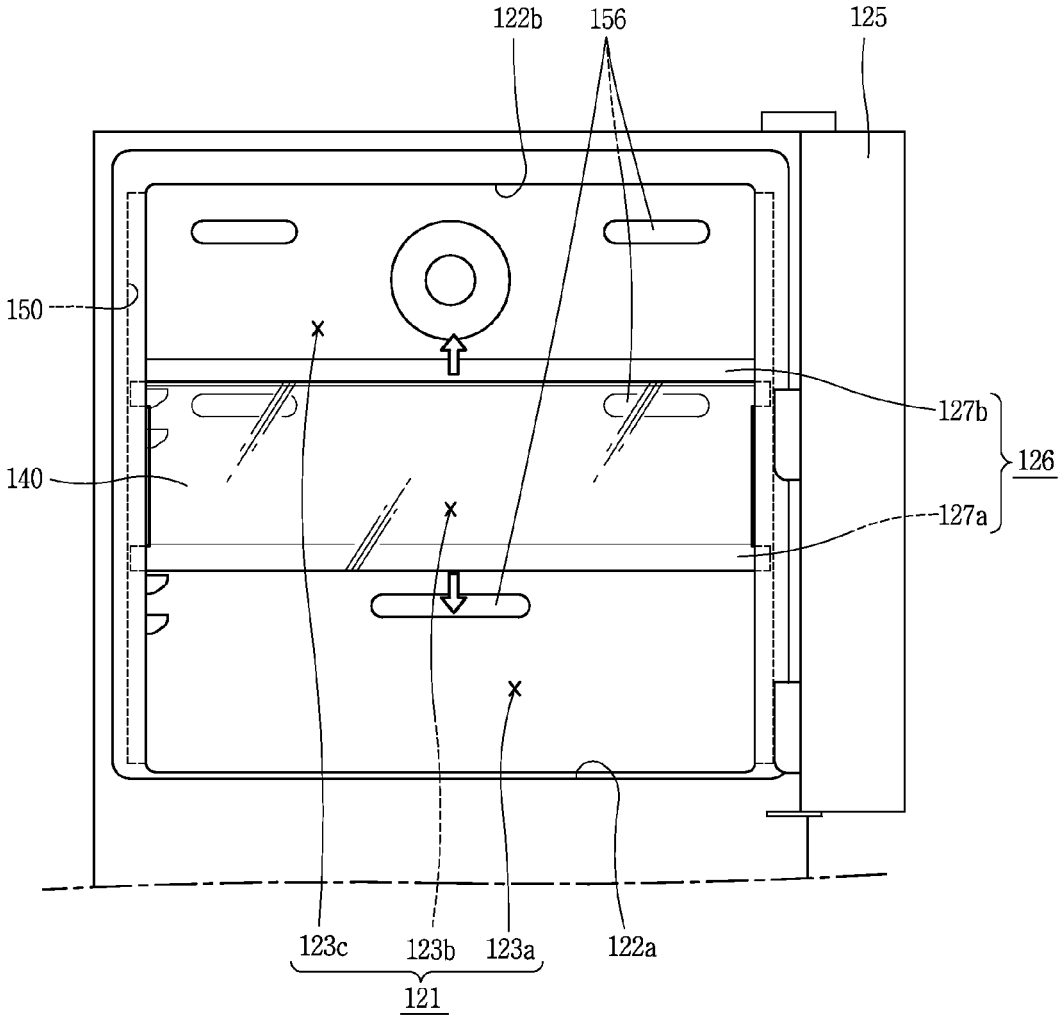
FIG. 6 is a view for explaining up-down movements of a cover of FIG. 2.
Figure 7:
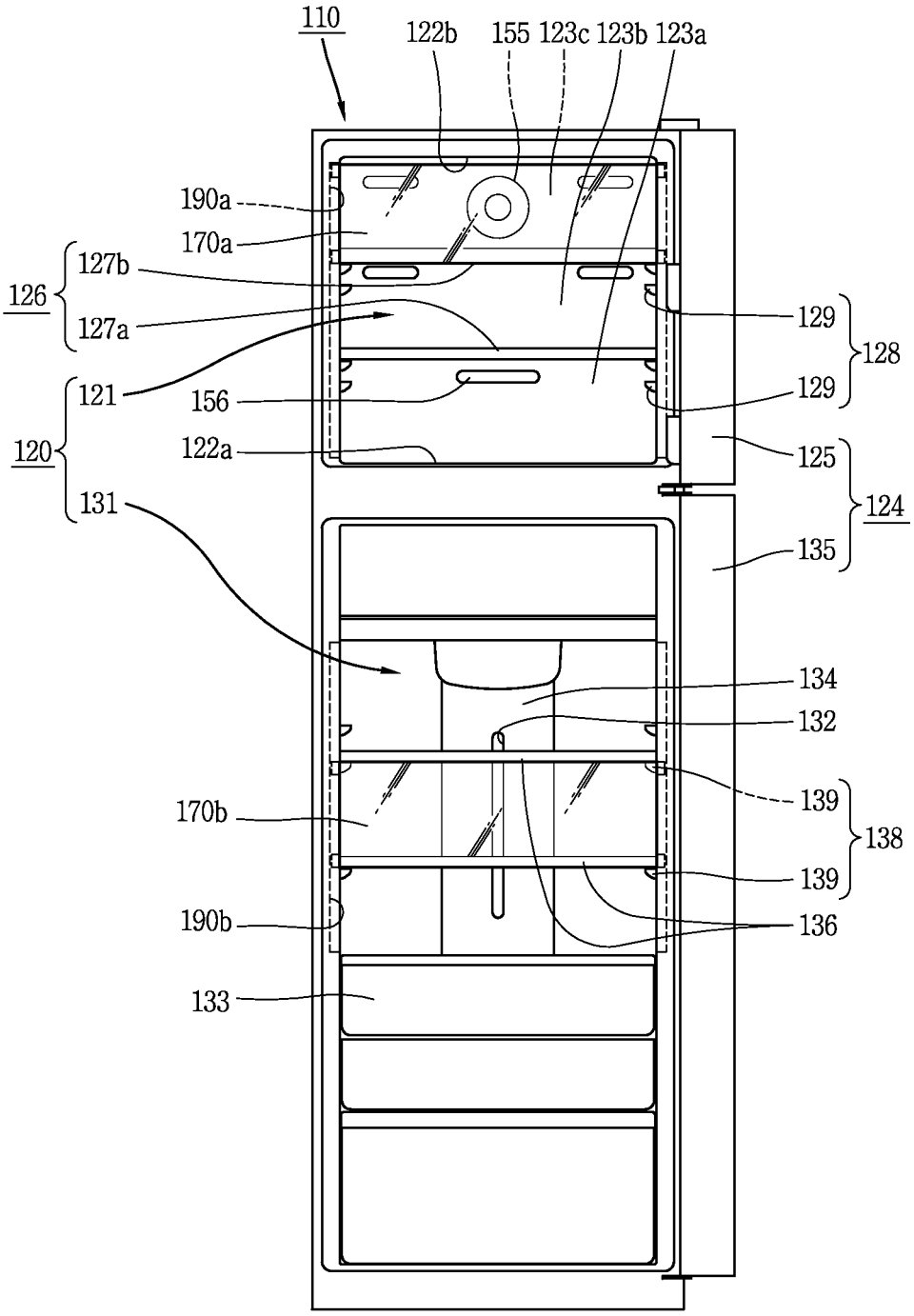
FIG. 7 is a front view showing an open state of a refrigerator according to another embodiment of the present invention.
Figure 8:
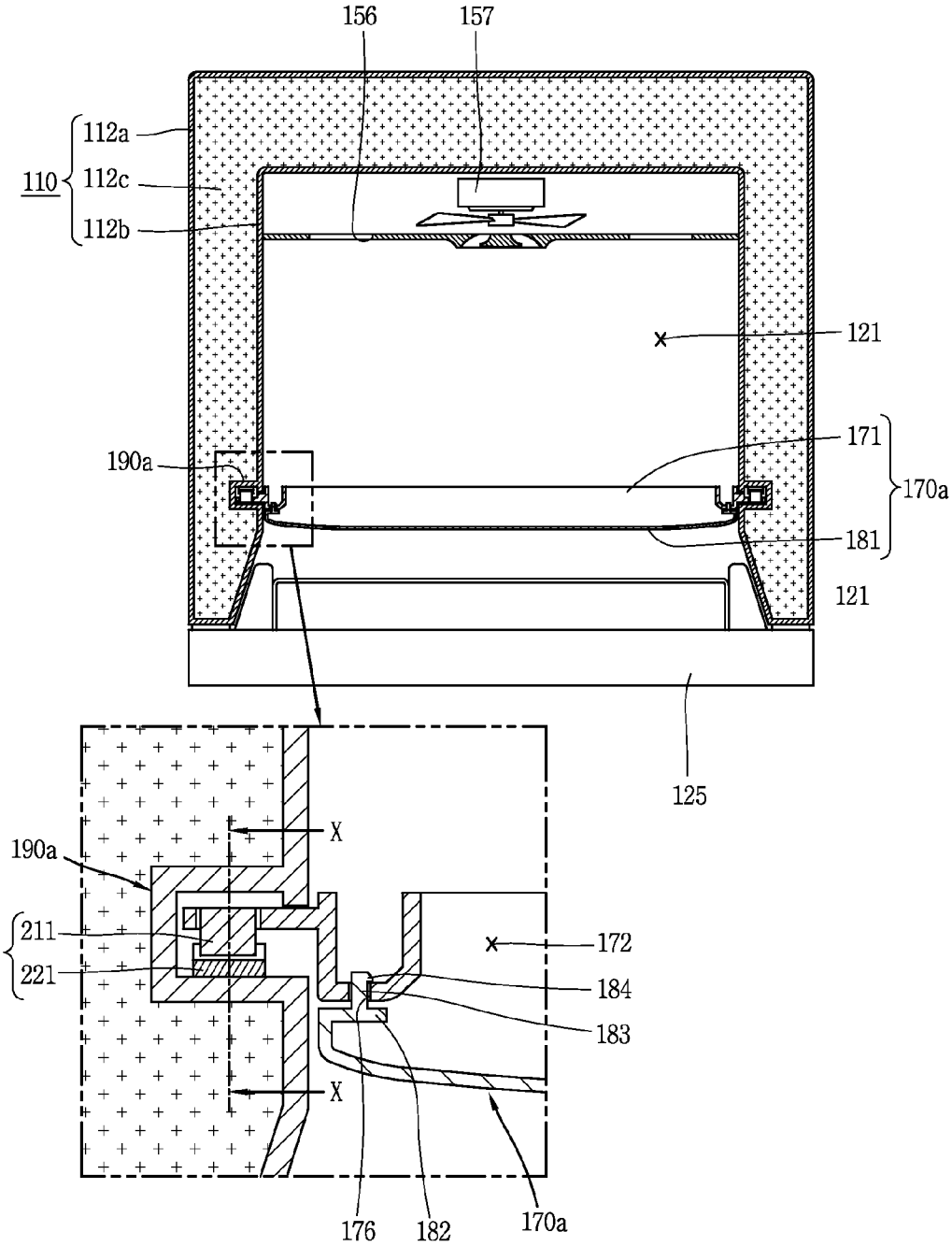
FIG. 8 is a planar sectional view of a freezing chamber of FIG. 7.

As shown in FIG. 6, the cover 140 may be disposed on a desired position by moving up and down. The cover 140 may be disposed at a position to block a front region of one of the lower compartment 123*a*, the middle compartment 123*b* and the upper compartment 123*c* partitioned from each other by the shelves 126. For instance, the cover 140 may be disposed at a front region of the upper compartment 123*c* to thereby block the front region of the upper compartment 123*c*.

Once the freezing chamber door 125 is open, cool air inside the freezing chamber 121 may leak to the outside and external air may be introduced into the freezing chamber 121, due to a temperature difference between the inside and the outside of the freezing chamber 121. However, since the cover 140 is disposed at a front region of the upper compartment 123*c* to thereby block the front region of the upper compartment 123*c*, cool air inside the upper compartment 123*c* is prevented from leaking to the outside, and external air is prevented from being introduced into the upper compartment 123*c*. As a result, a temperature change inside the upper compartment 123*c* can be prevented. Accordingly, food items accommodated in the upper compartment 123*c* are prevented from contacting external air having a relatively high temperature, thereby being prevented from being badly influenced by the external air.

Hereinafter, a refrigerator according to another embodiment of the present invention will be explained with reference to FIGS. 7 to 12.

The same components as those of the aforementioned embodiment have the same reference numerals for convenience, and the same explanations may be omitted.

The refrigerator according to another embodiment of the present invention may include a body 110 having a cooling chamber 120, a door 124 for opening or closing the cooling chamber 120, and covers 170*a* and 170*b* disposed at a front region of the cooling chamber 120 so as to be movable up and down.

A freezing chamber 121 may be provided at an upper region of the body 110.

A plurality of shelves 126 may be provided in the freezing chamber 121.

The shelves 126 may include a first shelf 127*a* and a second shelf 127*b* spaced from each other in upper and lower directions.

Shelf supporting portions 128 for supporting the shelves 126 may be provided on two side walls of the freezing chamber 121. The shelf supporting portions 128 may be provided with a plurality of support protruding portions 129 spaced from each other up and down, for control of the height of the shelves 126.

The first shelf 127*a* and the second shelf 127*b* may be spaced from each other up and down. Accordingly, a lower compartment 123*a*, a middle compartment 123*b* and an upper compartment 123*c* may be provided in the freezing chamber 121.

A plurality of drawers 133 may be provided at a lower region of the refrigerating chamber 131.

A plurality of shelves 136 may be provided at an upper region of the refrigerating chamber 131.

An upper space of the refrigerating chamber 131 may be divided into a plurality of regions by the shelves 136 in upper and lower directions.

Shelf supporting portions 138 for supporting the shelves 136 may be provided on two side walls of the refrigerating chamber 131.

The shelf supporting portions 138 may be provided with support protruding portions 139 spaced from each other up and down, so that the height of the shelves 136 can be controlled.

A cool air discharge opening 132 through which cool air is discharged toward the refrigerating chamber 131 may be formed at a rear region of the refrigerating chamber 131. The cool air discharge opening 132 may be configured as a slit having a long length in upper and lower directions.

An illumination portion 134 for illuminating the inside of the refrigerating chamber 131 may be provided at a rear region of the refrigerating chamber 131.

Covers 170*a* and 170*b* may be provided at front regions of the freezing chamber 121 and the refrigerating chamber 131, respectively.

Rails 190*a* and 190*b* for guiding the covers 170*a* and 170*b* to be movable up and down, may be provided at the freezing chamber 121 and the refrigerating chamber 131. The covers 170*a* and 170*b* provided at the freezing chamber 121 and the refrigerating chamber 131, respectively have a similar configuration. And, the rails 190*a* and 190*b* provided at the freezing chamber 121 and the refrigerating chamber 131, respectively have a similar configuration. Accordingly, the cover 170*a* and the rail 190*a* of the freezing chamber 121 will be explained hereinafter.

The rail 190*a* may be inward concaved from the two side walls of the freezing chamber 121, and may extend in upper and lower directions. Under such configuration, the cover 170*a* may move up and down in upper and lower directions of the freezing chamber 121.

The cover 170*a* may be formed to have the length corresponding to the width of the freezing chamber 121 in right and left directions.

The cover 170*a* may be configured to have a width in upper and lower directions, the width wide enough to block a front surface of at least one of the lower compartment 123*a*, the middle compartment 123*b* and the upper compartment 123*c* partitioned from each other by the first shelf 127*a* and the second shelf 127*b*.

For instance, the cover 170*a* may include a frame 171 that moves up and down along the rail 190*a*, and a plate portion 181 coupled to the frame 171.

Figure 9:
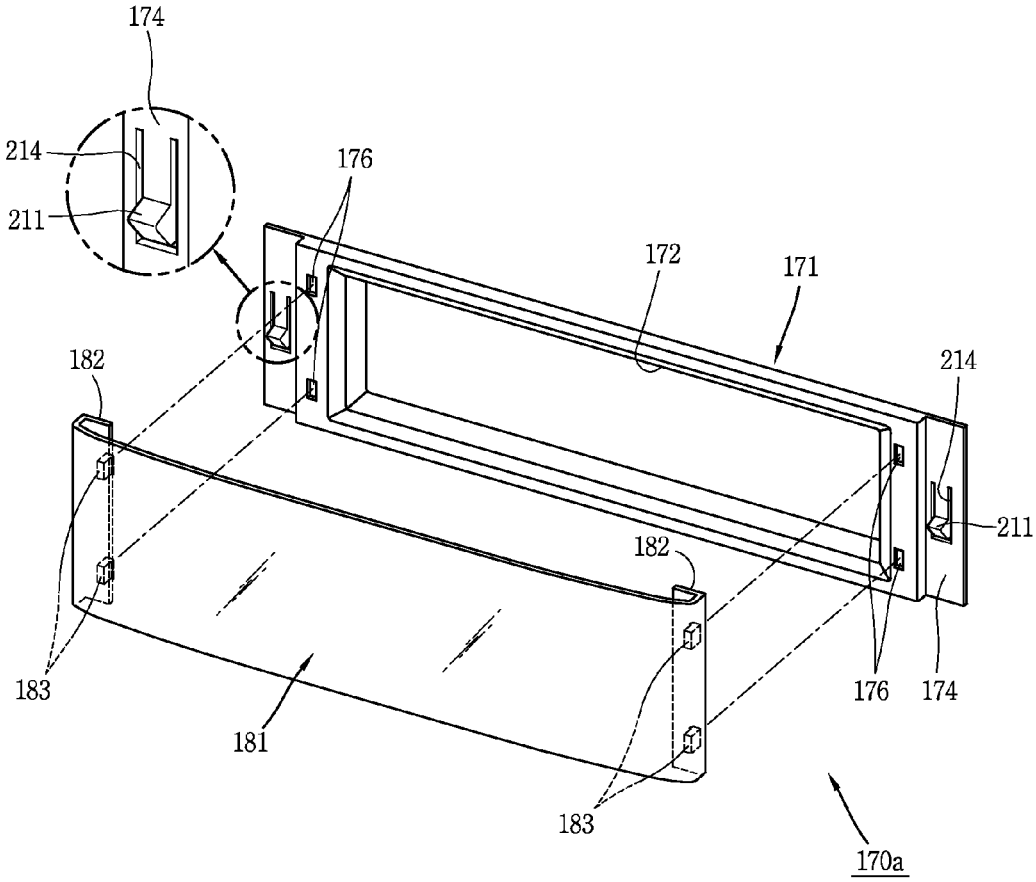
FIG. 9 is a disassembled perspective view of a cover of FIG. 8.
Figure 10:
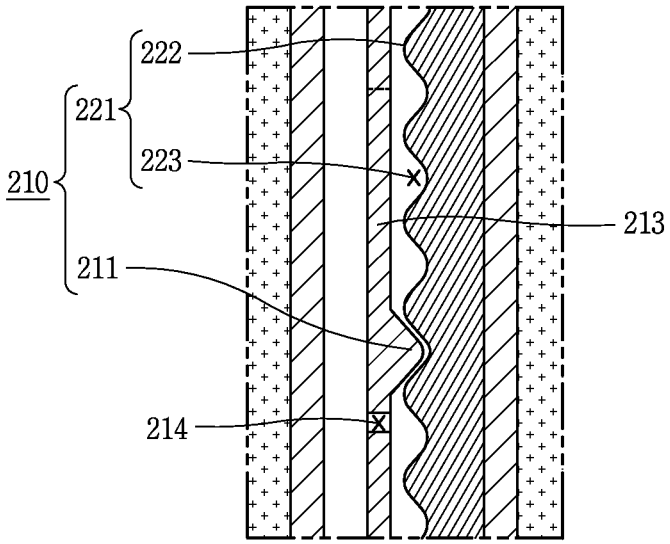
FIG. 10 is a sectional view taken along line 'X-X' in FIG. 8.

As shown in FIG. 9, the frame 171 may have the length corresponding to the width of the freezing chamber 121 in right and left directions.

An opening 172 may be formed at a central region of the frame 171.

The frame 171 may be formed in an approximate rectangular shape having the opening 172 at the central region thereof.

The frame 171 may be formed of a synthetic resin member.

Insertion portions 174 inserted into the rail 190*a* may be provided at two sides of the frame 171.

A plate coupling portion 176 for coupling the plate portion 181 may be formed at the frame 171.

The plate coupling portion 176 may be implemented as an opening or a hole which passes through the frame 171.

The plate coupling portion 176 may be formed at two sides of the opening, respectively. The plate portion 181 may be formed in a plate shape so as to block the opening 172.

A plurality of coupling protrusions 183 may be provided on the rear surface of the plate portion 181 so as to be coupled to the plate coupling portions 176.

The coupling protrusions 183 may protrude towards the rear side of the plate portion 181.

Bent portions 182 backward protruding and bent may be provided at two sides of the plate portion 181.

The coupling protrusions 183 may be provided at the bent portions 182.

Each of the coupling protrusions 183 may be provided with a stopping jaw 184 protruding in a widthwise direction. Under such configuration, the coupling protrusions 183 having been coupled to the plate coupling portions 176 can be prevented from being separated from the plate coupling portions 176.

A position fixing unit 210 for fixing the cover 170*a* at an upward or downward-moved position may be provided at a contact region between the cover 170*a* and the rail 190*a*. As a result, an upward or downward-moved position of the cover 170*a* can be properly set. This can prevent a temperature change occurring from a rear region of the cover 170*a* due to introduction of external air thereto when the cooling chamber 120 (freezing chamber 121 or the refrigerating chamber 131) is open.

The position fixing unit 210 may include a protrusion 211 moving up and down along the cover 170*a*, and an engaging portion 221 disposed along the rail 190*a* and engaged with the protrusion 211.

The engaging portion 221 may include top portions 222 protruding towards the protrusion 211, and bottom portions 223 concaved between the top portions 222 so as to be spaced from the protrusion 211.

The engaging portion 221 may be configured as a convex-concaved portion having a waveform section.

The top portions 222 and the bottom portions 223 may be formed to be alternating with each other in upper and lower moving directions of the cover 170*a*.

The engaging portion 221 may be provided in the rail 190*a*. For instance, the engaging portion 221 may be provided on a front inner wall of the rail 190*a*.

The protrusion 211 may be provided at the frame 171. More specifically, the protrusion 211 may be integrally formed with the insertion portions 174.

For instance, the protrusion 211 may forward protrude towards the insertion portions 174.

A protrusion supporting portion 213 may be formed at the periphery of the protrusion 211.

A slit 214 penetrated so that the protrusion 211 (protrusion supporting portion 213) can be elastically-transformed, may be formed on the circumference of the protrusion supporting portion 213.

Figure 13:
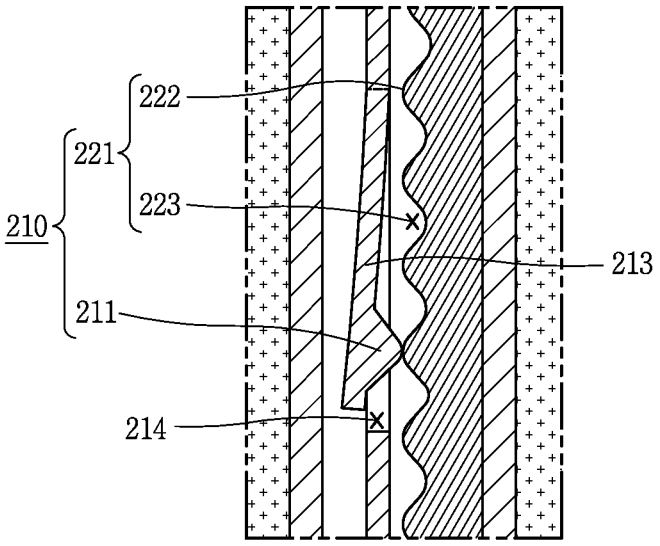
FIG. 13 is a view showing an elastically-transformed state of a protrusion supporting portion of FIG. 10.

As shown in FIG. 9, the protrusion supporting portion 213 may be formed in an approximate rectangular shape. That is, an upper end of the protrusion supporting portion 213 may be connected to the frame 171, and two side ends and a lower end thereof may be separated from the frame 171 by the slit 214. Under such configuration, the protrusion supporting portion 213 may be elastically-transformed in a thickness direction of the insertion portions 174, by an elastic force of the synthetic resins member. As shown in FIG. 13, the protrusion 211 is pressurized by the top portions 222 when contacting the top portions 222 of the engaging portion 221. Then, the pressurized protrusion 211 is transformed in a direction spaced from the engaging portion 221. Then, the protrusion 211 may return to the bottom portions 223 by its own elastic force after passing the top portions 222.

The protrusion 211 may be individually formed from the cover 170*a*, and may be coupled to the cover 170*a*.

Figure 11:
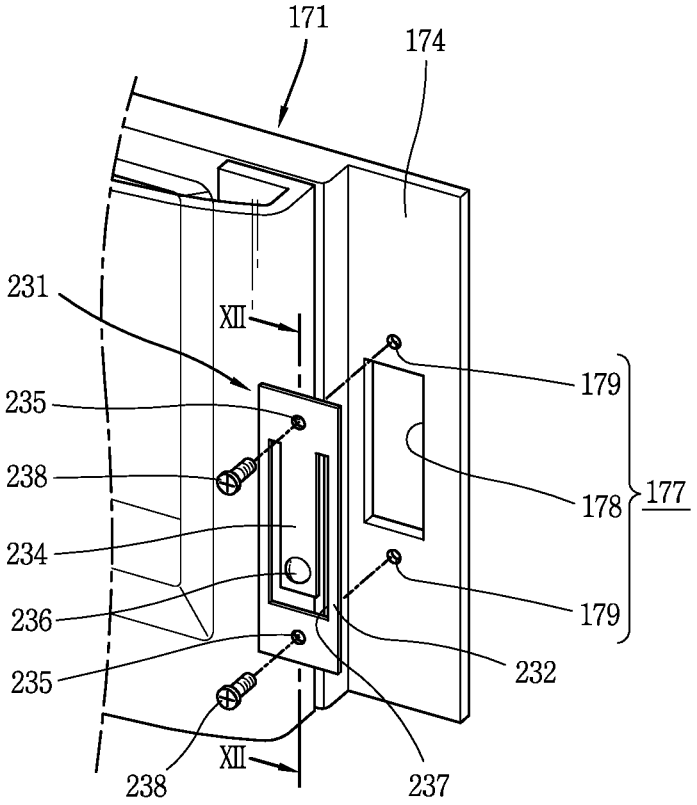
FIG. 11 is a modification example of a position fixing unit of FIG. 9.
Figure 12:
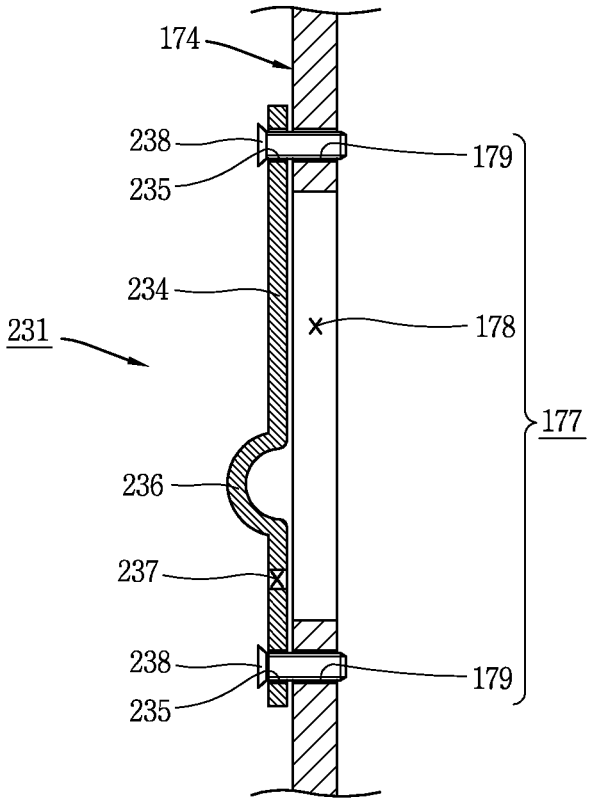
FIG. 12 is a sectional view taken along line 'XII-XII' in FIG. 11.

As shown in FIGS. 11 and 12, a position fixing unit 230 may include a protrusion unit 231 formed of a metallic member so as to be elastically-transformable, and an engaging portion 221 engaged with the protrusion unit 231.

The protrusion unit 231 may include a body 232 formed of a metallic member (e.g., spring steel) and having a plate shape, a protrusion supporting is portion 234 formed by cutting the body 232, and a protrusion 236 protruding from the protrusion supporting portion 234. A slit 237 may be penetratingly-formed on the circumference of the protrusion supporting portion 234. Under such configuration, the protrusion supporting portion 234 (or the protrusion 236) may be elastically-transformed with respect to the body 232.

Figure 14:
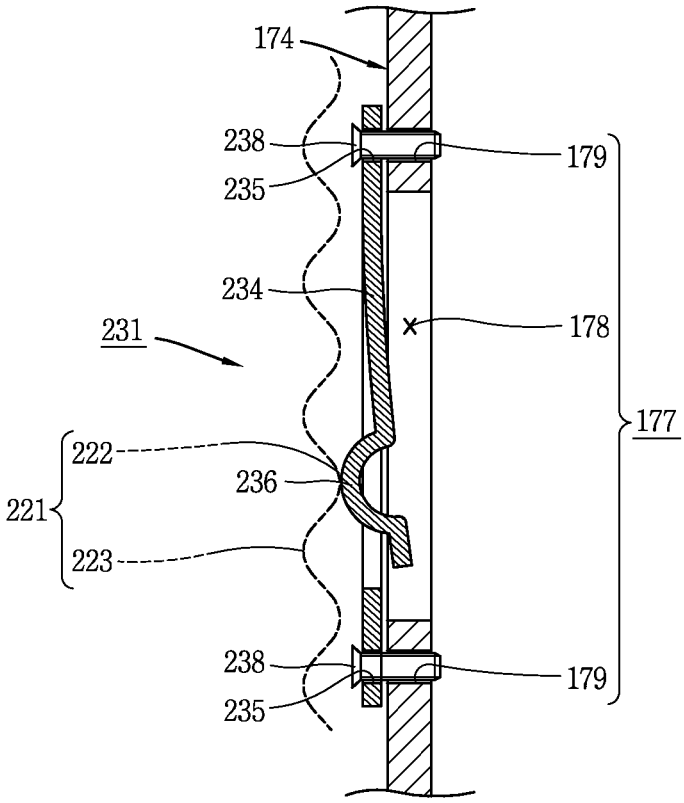
FIG. 14 is a view showing an elastically-transformed state of a protrusion supporting portion of FIG. 12.

More specifically, the protrusion supporting portion 234 is formed in an approximate rectangular shape. And, a slit 237 is formed at the periphery of two side edges and a lower edge so that the protrusion supporting portion 234 can be separated from the body 232. Under such configuration, if the protrusion supporting portion 234 is pressurized in a thickness direction when the protrusion 236 comes in contact with the top portions 222 of the engaging portion 221, the protrusion supporting portion 234 is backward elastically-transformed as shown in FIG. 14. On the other hand, if the protrusion 236 comes in contact with the bottom portions 223 of the engaging portion 221, the protrusion supporting portion 234 may return to the initial position by its own elastic force.

The protrusion unit 231 may be coupled to the frame 171 by a coupling member 238 (e.g., screws). A coupling hole 235 for coupling the coupling member 238 may be penetratingly-formed at the body 232 of the protrusion unit 231.

A protrusion unit coupling portion 177 for coupling the protrusion unit 231 may be provided at the insertion portions 174 of the frame 171. The protrusion unit coupling portion 177 may be provided with a accommodation space 178 so that the protrusion unit 231 can be elastically-transformed. For instance, the accommodation space 178 may be penetratingly-formed at the insertion portions 174.

The protrusion unit coupling portion 177 may be provided with a coupling member connecting portion 179 for coupling the coupling member 238. The coupling member connecting portion 179 may be provided at the upper and lower sides of the accommodation space 178. The coupling member connecting portion 179 may be implemented as a female screw portion.

Under such configuration, the engaging portion 221 may be provided in the rail 190*a*, respectively.

The two insertion portions 174 of the frame 171 of the cover 170*a* may be inserted into the rail 190*a*, respectively.

Once the insertion portions 174 are inserted into the rail 190*a*, the protrusions 211 may elastically come in contact with the engaging portion 221. As a result, the cover 170*a* can be fixed to the inserted position without downward moving.

The cover 170*a* may move to a desired position by upward or downward moving.

For instance, if the cover 170*a* is upward pressurized, the protrusion 211 is backward elastically-transformed by contacting the top portions 222 of the engaging portion 221. If the protrusion 211 continuously moves to pass through the top portions 222, the protrusion 211 returns to the front bottom portion 223 by its own elastic force. The upward-moved protrusion 211 contacts the next top portion 222 thus to be backward elastically-transformed. Then, the protrusion 211 returns to the bottom portion 223 by its own elastic force. The protrusion 211 may continue to upward move by repeating such processes.

If the upward-pressurizing force applied to the cover 170*a* is released, the protrusion 211 elastically-contacts the engaging portion 221 by its own elastic force. This can prevent the cover 170*a* from being suddenly lowered.

Once the freezing chamber door 125 is open, cool air inside the freezing chamber 121 may leak to the outside, and external air may be introduced into the freezing chamber 121.

The cover 170*a* may prevent cool air which exists at the rear region thereof from leaking to the outside, and may prevent external air from being introduced into the rear region thereof. Accordingly, a temperature change occurring from the rear region of the cover 170*a* can be prevented.

As aforementioned, in the present invention according to one embodiment, the cover is provided at the front region of the cooling chamber. This can prevent external air from being introduced into the cooling chamber when the door of the cooling chamber is open. Accordingly, a temperature change occurring from the rear region of the cover 170*a* can be prevented.

Furthermore, since the cover is provided at the front region of the freezing chamber, external air is prevented from being introduced into the rear region of the cover when the freezing chamber is open. As a result, a temperature change occurring from the rear region of the cover, due to introduction of external air, can be prevented.

Besides, since the cover which is movable up and down is provided at the front region of the cooling chamber, the position of the cover can be controlled. This can prevent a temperature change occurring from the rear region of the cover when the cooling chamber is open.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A refrigerator, comprising:

a body having a cooling chamber divided into a plurality of compartments by one or more shelves;

a door configured to open or close the cooling chamber;

a rail concaved from a surface of side walls of the cooling chamber and extended in upper and lower directions;

a cover disposed at a front region of the cooling chamber and the cover is configured to be movable up and down along the rail, wherein an insertion portion is inserted into the rail and provided at the cover, and whereby the cover selectively blocks a part of the plurality of compartments; and a position fixing unit configured to fix the cover to an upward or downward-moved position, wherein the position fixing unit includes:

a protrusion unit provided at the cover; and an engaging portion engaged with the protrusion unit, wherein the protrusion unit comprises a body having a plate shape and a protrusion supporting portion elastically-transformable back and forth directions of the body according to a shape of the engaging portion when a protrusion moves on the engaging portion, wherein the protrusion is provided at the protrusion unit.

2. The refrigerator of claim 1, wherein the cover is detachable.

3. The refrigerator of claim 1, wherein the cooling chamber includes a freezing chamber and a refrigerating chamber, and the cover is provided at the freezing chamber or the refrigerating chamber.

4. The refrigerator of claim 1, wherein the engaging portion is configured as a convex-concaved portion having a waveform section.

5. The refrigerator of claim 1, wherein the protrusion elastically comes in contact with the engaging portion.

6. The refrigerator of claim 1, wherein the protrusion unit is detachably coupled to the cover.

7. The refrigerator of claim 1, wherein a slit is formed at a circumference of the protrusion supporting portion such that one region of the protrusion supporting portion is connected to the body, and another region thereof is separated from the body.

8. The refrigerator of claim 1, wherein the cover includes:

a frame that moves up and down along the rail and having an opening at a central region of the frame; and a plate portion coupled to the frame and the plate portion blocks the opening, wherein the protrusion unit is provided at the frame.

9. The refrigerator of claim 8, wherein a slit is formed at a circumference of the protrusion such that one region of the protrusion is connected to the frame, and another region thereof is separated from the frame.

10. The refrigerator of claim 8, wherein the frame is detachably coupled to the plate portion.

11. The refrigerator of claim 10, wherein the frame comprises a plate coupling portion having one or more holes which passes through the frame and the plate portion comprises one or more coupling protrusions coupled to the plate coupling portion.

12. The refrigerator of claim 8, wherein the protrusion unit is detachably coupled to the frame.

* * * * *